United States Patent [19]

Smith, Jr.

[11] 4,148,634

[45] Apr. 10, 1979

[54] MACHINABILITY OF ALLOY 688 AND MODIFIED 688 THROUGH THE ADDITION OF Pb

[75] Inventor: Warren F. Smith, Jr., Branford, Conn.

[73] Assignee: Olin Corporation, New Haven, Conn.

[21] Appl. No.: 858,116

[22] Filed: Dec. 7, 1977

[51] Int. Cl.[2] ..... C22C 9/04

[52] U.S. Cl. ..... 75/157.5; 75/162

[58] Field of Search ..... 75/157.5, 162

[56] References Cited

U.S. PATENT DOCUMENTS

| | | | |
|---|---|---|---|
| 3,214,269 | 10/1965 | Lunn | 75/153 |
| 3,703,367 | 11/1972 | Cocks | 75/157.5 |
| 3,963,526 | 6/1976 | Lunn | 148/2 |

FOREIGN PATENT DOCUMENTS

| | | | |
|---|---|---|---|
| 205828 | 3/1959 | Austria | 75/157.5 |
| 1173559 | 12/1969 | United Kingdom | 75/157.5 |

*Primary Examiner*—L. Dewayne Rutledge
*Assistant Examiner*—Upendra Roy
*Attorney, Agent, or Firm*—Paul Weinstein

[57] ABSTRACT

The improved machinability of standard Alloy 688 and modified 688 is achieved through the addition of lead to the alloy. This machinability improvement in Alloy 688 is not achieved at the detriment of the well-known strength of Alloy 688.

13 Claims, No Drawings

MACHINABILITY OF ALLOY 688 AND MODIFIED 688 THROUGH THE ADDITION OF PB

BACKGROUND OF THE INVENTION

Standard Alloy 688 (nominal composition of 73.5% Cu, 22.7% Zn, 3.4% Al and 0.4% Co) is well known for its combination of high strength, good formability and ease of processing. Alloy 688 is widely utilized as a material for springs, switches, contacts, relays, drawn and fabricated parts. It is also known, however, that Alloy 688 suffers from having poor machinability characteristics. For example, the machinability rating of Alloy 688, when compared to a rate of 100 for Free Cutting Brass, is 20.

It is well known that additions of lead tend to improve the machinability properties of several copper base alloy systems. These particular alloys suffer from the disadvantage that they possess low strength properties and are not easily hot workable. It has not been known before that lead additions to both standard and modified Alloy 688, which is well known as a high strength alloy, would significantly improve its machinability.

Accordingly, it is a principal object of the present invention to improve the machinability properties of standard and modified Alloy 688.

It is an additional object of the present invention to improve the machinability properties as above through the use of alloying elements and not any particular processing.

Further objects and advantages of the present invention will become apparent from a consideration of the following specification.

SUMMARY OF THE INVENTION

The foregoing objects are readily accomplished by the present invention through the addition of lead as an alloying element to both standard and modified Alloy 688. This alloying addition greatly enhances the machinability of the alloys without significantly affecting the strength properties of the alloys.

DETAILED DESCRIPTION

An increase in the machinability of standard and modified Alloy 688 is provided by the addition of 0.1 to 4% by weight of lead to the alloys. Additions of lead less than 0.1% by weight show a negligible improvement in machinability in the alloys while additions of lead greater than 4% by weight restrict cold formability and processing of the alloys. No restrictions on the compositon of either standard or modified Alloy 688 are required but for best hot workability, it is preferred that the aluminum content in the alloy exceed 3.4% and that the aluminum content be less than 3.8% for optimum cold workability.

The other elements within the alloys must also be present within the specific ranges. The copper content of the alloys should fall within the range of 66 to 80% by weight and preferably from 70 to 76% by weight. If the percentage of copper within the alloys is below 66% by weight, the strength of the final alloy suffers markedly and if the percentage of copper is above 76 to 80% by weight, an additional phase forms in the alloy which limits the ductility of the particular alloy. The zinc content of the alloys should be within the range of 15 to 32.5% by weight and preferably from 19 to 29% by weight. The aluminum content should range from 1 to 5% by weight and preferably from 2 to 4.5% by weight. As noted above, it is most preferred that the aluminum content range between 3.4 and 3.8% by weight for best hot and cold workability properties in the alloys. The element selected from the group consisting of cobalt, nickel, iron, chromium and titanium is present in the alloys at a much lower percentage range than the other elements, namely from 0.1 to 3% by weight for each of cobalt, titanium and chromium, from 0.2 to 5% by weight nickel and from 0.2 to 1.5% by weight iron. The preferred percentage ranges for these elements are from 0.1 to 1.5% by weight for each of chromium and titanium, from 0.1 to 1% by weight cobalt, from 0.4 to 2% by weight nickel and from 0.2 to 1% by weight iron. The amount of additional element present in the alloy determines the eventual ductility of the alloy since the preferred weight range for each element gives the highest ductility values while the higher weight range for each element generally lowers the ductility of the alloy. Little improvement in the physical properties of the alloy is realized above the upper weight percentage for each element since the excess element within the alloy appears as elemental metal particles or as massive element-aluminum intermetallic compounds.

Generally, the alloys containing lower amounts of these elemental additions are high strength, high ductility materials while the alloys containing higher amounts of these elements provide even higher strength properties but lower the ductility of the alloy. Apparently, there is a trade-off within the alloy between high strength and ductility. For example, in those alloys containing either cobalt, chromium or titanium additions, the aluminum content within the alloy should be in the range of 1.2 to 3.2% by weight at approximately the 69% by weight level for copper in order to insure a combination of high ductility and high strength in the alloy. For those alloys containing iron, the aluminum content should be in the range of 1.5 to 3.1% by weight at the 69% by weight level for copper. The nickel-containing alloys should contain 1.5 to 4.0% by weight aluminum at approximately the 71.5% by weight copper level. At the 74% by weight concentration for copper within those alloys containing either cobalt, chromium or titanium, the aluminum content should be in the range of 3 to 5% by weight for the same reasons. At this same copper level in the nickel-containing alloy, the aluminum content should range from 2.5 to 5.0% by weight. At the 75 weight percent concentration for copper in the iron-containing alloy, the aluminum content should range from 3.5 to 5% by weight. Proportional adjustments of aluminum within the alloys for the various copper contents within the noted ranges should preferably be made for a combination of high strength and high ductility. Furthermore, this aluminum content should also be related to the zinc content within the alloys in order to achieve the desired combination of ductility and strength.

The alloys of the present invention may include conventional impurities typically found in similar copper base alloys. Additionally, other alloying ingredients may be added to the base system to achieve particular results. Such ingredients, in impurity levels, may include tin, phosphorus, iron, manganese, nickel and silicon. For minimizing dezincification in corrosive environments, such elements as arsenic, antimony and phosphorus, or combinations thereof, in amounts ranging from 0.02 to 0.1% by weight may be added to the alloys.

Processing of the alloy system requires no unusual treatment. Melting and casting of the alloy may be performed under similar conditions as with commercially available brass alloys. Direct chill (DC) casting is particularly suitable for casting the alloy system of the present invention. Hot working of this alloy system is easily accomplished using normal brass mill techniques. Under rapid cooling conditions, a non-equilibrium structure may be obtained in the alloy which reduces the initial cold workability of the alloy. This may be overcome by annealing the specific alloy to obtain approximate equilibrium porportions of alpha and beta phases within the alloy. It has been noted in the processing of these alloys that they exhibit a high response to low temperature stress relief annealing following cold working. Due to the stabilizing influence of the elemental addition on the alloy structure, the properties of recrystallization annealed material formed from the alloys are also stable over an extended temperature range. Tensile strength is uniform while elongation increases over the same range of temperature.

Further objects and advantages of the present invention will become more apparent from a consideration of the following illustrative examples.

EXAMPLE I

Standard Alloy 688 containing 1% by weight and 2% by weight of lead was fabricated into 0.3" thick sheet material using normal processing methods. These methods included casting by the Durville method, hot rolling and annealing. The sheet material for each addition of lead, as well as standard Alloy 688 and Alloy 360 for comparison purposes, was tested using a standard laboratory drill machinability method. This method consisted of drilling a series of ¼" holes in a test sample and measuring the time required to drill a hole of constant depth. These results were compared with the machinability of standard Alloy 688 and Alloy 360 (or Free Cutting Brass). The standard machinability rating system was utilized in which Alloy 360 was considered to be 100% machinable. In other words, Alloy 360 was assigned a machinability rating of 100. Machinability was calculated on the basis of the following equation:

$$\text{Machinability} = \frac{\text{drilling time for comparison alloy}}{\text{drilling time for Alloy 360}} \times 100$$

Table I indicates the results of these machinability tests.

TABLE I

COMPARISON OF MACHINABILITY RATINGS FOR ALLOYS 360, 688 AND Pb MODIFIED 688

| Alloy | Machinability Rating |
|---|---|
| 360 | 100 |
| 688 | 26 |
| 688 + 1% Pb | 66.5 |
| 688 + 2% Pb | 76.1 |

Table I illustrates a significant improvement in machinability rating when additions of lead are made to standard Alloy 688. With an addition of 1% lead, the machinability increases from 26 to 66.5 and is further increased to 76.1 with the addition of 2% lead.

EXAMPLE II

Standard Alloy 688 modified with both 1% by weight and 2% by weight of lead was fabricated according to the process of Example I with the exception that processing was continued to subject the sheet material to a 30% cold working reduction after hot rolling and annealing. The strength properties for each sample of material as well as for standard Alloy 688 were measured and the results are shown in Table II.

TABLE II

COMPARISON OF STRENGTH PROPERTIES FOR STANDARD ALLOY 688 AND Pb MODIFIED 688

| Alloy | Yield Strength, ksi | Ultimate Tensile Strength, ksi |
|---|---|---|
| 688 | 97 | 104 |
| 688 + 1% Pb | 96 | 107 |
| 688 + 2% Pb | 96 | 108 |

Table II indicates that the lead additions to standard Alloy 688 do not materially affect the strength properties of the alloy. This is quite surprising since lead additions to various alloys in the art have generally been detrimental to the strength properties of the particular alloys. This has always been taken as the trade-off for improved machinability properties in these alloys.

It is quite clear from the significantly improved machinability rating results of this example that the alloy system of the present invention achieves greatly improved machinability over standard Alloy 688. This improvement is so substantial as to approach the machinability rating of Alloy 360, which is the industry standard for machinability. This improvement in machinability does not detrimentally affect the overall strength properties of Alloy 688. This improvement in machinability properties while maintaining strength properties is quite surprising since lead has usually increased machinability at the expense of strength in numerous alloys. Therefore, the admirable combination of high machinability and high strength is readily attained with the alloy system of the present invention.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy consisting essentially of from 66 to 80% by weight copper, from 15 to 32.5% by weight zinc, from 1 to 5% by weight aluminum, an element selected from the group consisting of 0.1 to 3% by weight for any of cobalt, titanium and chromium, 0.2 to 5% by weight nickel and 0.2 to 1.5% by weight iron, and between 1% and 4% by weight lead, the said alloy being characterized by strength properties essentially the same as in an alloy having the same composition as said alloy without lead, together with substantial improvement thereover in its machinability.

2. An alloy according to claim 1 wherein said copper is present in an amount ranging from 70 to 76% by weight.

3. An alloy according to claim 1 wherein said zinc is present in an amount ranging from 19 to 29% by weight.

4. An alloy according to claim 1 wherein said aluminum is present in an amount ranging from 2 to 4.5% by weight.

5. An alloy according to claim 4 wherein said aluminum is present in an amount between 3.4 and 3.8% by weight.

6. An alloy according to claim 1 wherein said cobalt is present in an amount ranging from 0.1 to 1% by weight.

7. An alloy according to claim 1 wherein said titanium is present in an amount between 0.1 and 1.5% by weight.

8. An alloy according to claim 1 wherein said chromium is present in an amount ranging from 0.1 to 1.5% by weight.

9. An alloy according to claim 1 wherein said nickel is present in an amount ranging from 0.4 to 2% by weight.

10. An alloy according to claim 1 wherein said iron is present in an amount ranging from 0.2 to 1% by weight.

11. An alloy according to claim 1 wherein the alloy further includes an addition in an amount ranging from 0.02 to 0.1% by weight of an element selected from the group consisting of arsenic, antimony, phosphorus, and mixtures thereof.

12. A copper base alloy consisting essentially of 70 to 76% by weight of copper, 19 to 29% zinc, 1 to 5% aluminum, 0.1 to 1% cobalt, and between 1% and 4% lead, the said alloy being characterized by strength properties essentially the same as in an alloy having the same composition as said alloy without lead, together with substantial improvement thereover in its machinability.

13. An alloy according to claim 12, containing between 1% and 2% by weight of lead, said alloy being characterized by a yield strength of 96 ksi and ultimate tensile strength of over 104 ksi, together with a machinability rating increased thereover from a value of 26 to 66.

* * * * *